US009565892B2

(12) United States Patent
Spector

(10) Patent No.: US 9,565,892 B2
(45) Date of Patent: Feb. 14, 2017

(54) LATERAL SUPPORT SYSTEM FOR FEET

(71) Applicant: Donald Spector, New York, NY (US)

(72) Inventor: Donald Spector, New York, NY (US)

( * ) Notice: Subject to any disclaimer, the term of this patent is extended or adjusted under 35 U.S.C. 154(b) by 48 days.

(21) Appl. No.: 14/795,151

(22) Filed: Jul. 9, 2015

(65) Prior Publication Data

US 2016/0331069 A1 Nov. 17, 2016

Related U.S. Application Data

(60) Provisional application No. 62/160,102, filed on May 12, 2015.

(51) Int. Cl.

| | |
|---|---|
| ***A43B 3/16*** | (2006.01) |
| ***A43B 7/14*** | (2006.01) |
| ***A43C 19/00*** | (2006.01) |

(52) U.S. Cl.

CPC ..... *A43B 7/14* (2013.01); *A43B 3/163* (2013.01); *A43C 19/00* (2013.01)

(58) Field of Classification Search

CPC ..... A43B 7/00; A43B 7/14; A43B 3/16; A43B 3/163; A47D 13/04; A61F 5/0102; A61F 5/0111

USPC ..... 36/136, 116, 7.5, 7.6, 7.1 R, 7.3,36/122–125, 140

See application file for complete search history.

(56) References Cited

U.S. PATENT DOCUMENTS

| | | | | | |
|---|---|---|---|---|---|
| 2,284,190 | A * | 5/1942 | Evans | H02G 1/02 | 182/221 |
| 2,724,193 | A * | 11/1955 | McDermott | A43B 3/16 | 36/1 |
| 3,844,054 | A | 10/1974 | Morris | | |
| 4,122,577 | A * | 10/1978 | Catania | A46B 15/00 | 15/160 |
| 4,335,529 | A * | 6/1982 | Badalamenti | A43B 5/00 | 36/114 |
| 4,712,317 | A * | 12/1987 | Sowell | A43B 5/025 | 36/132 |
| 4,748,753 | A * | 6/1988 | Ju | A43B 5/001 | 36/127 |
| 5,274,932 | A * | 1/1994 | Malloy | B63B 35/7936 | 36/114 |
| 5,875,569 | A * | 3/1999 | Dupree | A43B 13/143 | 36/103 |
| 6,457,976 | B1 | 10/2002 | Fleshman | | |
| 6,474,006 | B1 | 11/2002 | Cummings et al. | | |
| 7,849,611 | B2 | 12/2010 | Dean | | |
| D634,918 | S | 3/2011 | Katz et al. | | |
| 8,776,402 | B2 | 7/2014 | Cromer, Jr. | | |
| 2002/0091020 | A1* | 7/2002 | Pierce | A43B 5/18 | 473/452 |
| 2009/0260259 | A1* | 10/2009 | Berend | A43B 7/142 | 36/88 |

(Continued)

*Primary Examiner* — Ted Kavanaugh

(74) *Attorney, Agent, or Firm* — Collard & Roe, P.C.

(57) ABSTRACT

A stability system is formed from a support wedge having a bottom, an inner surface and an outer surface and a bottom platform connected to the bottom of the support wedge and extending past the inner surface to create a space for receiving a bottom of the shoe. There are attachment devices connected to the support wedge and bottom platform for connecting the stability system to a shoe. The support wedge is formed from an elastic material that compresses to a predetermined degree upon application of a downward force, such that the stability system exerts increasing resistance as the downward force increases.

14 Claims, 3 Drawing Sheets

(56) References Cited

U.S. PATENT DOCUMENTS

| | | | | |
|---|---|---|---|---|
| 2012/0102787 | A1* | 5/2012 | Haskell | A43B 5/00 36/136 |
| 2014/0325875 | A1* | 11/2014 | Lee | A43C 13/00 36/73 |

* cited by examiner

LATERAL SUPPORT SYSTEM FOR FEET

CROSS REFERENCE TO RELATED APPLICATIONS

Applicant claims priority under 35 U.S.C. §119(e) of U.S. Provisional Patent Application Ser. No. 62/160,102 filed May 12, 2015, the disclosure of which is incorporated by reference.

BACKGROUND OF THE INVENTION

1. Field of the Invention

The present invention relates to a lateral support system for attachment to shoes or the legs of a person. In particular the invention relates to a lateral support system that attaches to shoes or the legs and prevents a person from falling sideways.

2. The Prior Art

People who have mobility issues often use a cane or a walker to assist in walking from place to place. These objects are bulky, cumbersome and require the use of at least one hand, and are thus inconvenient to use. It would be desirable to provide a stability system that does not require the use of the person's hands and which is not bulky or cumbersome.

SUMMARY OF THE INVENTION

It is therefore an object of the invention to provide a stability system that allows the user to have both hands free. It is another object of the invention to provide a stability system that is unobtrusive and easy to use.

These and other objects are accomplished by a stability system comprising a support wedge having a bottom, an inner surface and an outer surface, and a bottom platform connected to the bottom of the support wedge and extending past the inner surface to create a space for receiving a bottom of the shoe. There are attachment devices connected to the support wedge and bottom platform for connecting the stability system to a shoe. The shoe is placed on the bottom platform with the stability wedge adjacent the outer side of the shoe, and the attachment devices are then engaged to connect the stability system to the shoe. The extra width afforded by the support wedge provides increased stability to prevent sideways falls by the wearer.

The support wedge is formed from an elastic material that compresses to a predetermined degree upon application of a downward force, such that the stability system exerts increasing resistance as the downward force increases. This way, if the wearer begins to lean sideways, the stability wedge will exhibit increasing resistance against downward pressure to keep the wearer upright. The variable compression allows the wedge to "give" a little in the beginning so as to be more comfortable. The support wedge can be made using a 3-D printer or by any suitable means. The support wedge can be of a unitary material or made of layers of different materials with different compression characteristics.

In a preferred embodiment, the inner and outer surfaces meet at a top edge so that the wedge has a triangular cross section. This limits the bulkiness of the wedge without affecting its stability.

The attachment devices can be any suitable system for attaching the support wedge to a shoe. Examples of suitable attachment means are straps, hooks, adhesives, hook-and-loop-type fasteners (VELCRO®), D-rings and clips.

The support wedge is preferably formed from rubber or plastic, but any other material or combination of materials could be used as well.

Preferably, the bottom platform is equipped with treads on a bottom surface thereof to increase slip resistance of the system.

The support wedge can be of any desired size. Preferably, the bottom of the support wedge is between 1 and 3 inches wide. This size is ideal for preventing sideways falls without being too bulky or cumbersome.

The bottom platform and support wedge can be formed in one piece or can be in two separate pieces that are connected together.

In an alternative embodiment, stability system can be attached to a leg of a person to provide additional lateral support. In this embodiment, the stability system comprises a support wedge having a bottom, an inner surface and an outer surface, a bottom platform connected to the bottom of the support wedge and extending past the inner surface to create a space for receiving a bottom of the shoe, and a plurality of springs having a bottom end connected to a top of the support wedge and extending up to a top of the stability system. There are attachment devices connected to bottom platform or support wedge for connecting the stability system to a shoe, and an attachment strap at a top end of the stability system for attaching the stability system to a person's leg.

The springs compress a predetermined degree upon application of a downward force, such that the stability system exerts increasing resistance as the downward force increases. Any type of compression spring can be used, such as standard steel helical compression springs, pneumatic or hydraulic springs.

The attachment means can be any suitable means for connecting the support wedge to the shoe. Suitable attachment means can be straps, hooks, adhesives, hook-and-loop-type fasteners, D-rings and clips.

As with the first embodiment, the support wedge is preferably formed from rubber or plastic, but any other material or combination of materials could be used as well. The support wedge can have a triangular or trapezoidal shaped cross-section.

The system of the present invention is intended to be inexpensive, comfortable, easy to put on and use, and compatible with any size foot. The bottom portion can be made in various sizes to accommodate all sizes of feet. The bottom portion could even be made adjustable or trimmable so that one size system could fit all.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Referring now in detail to the drawings and, in particular, FIGS. 1-5 show a first embodiment of the stability system 10 according to the invention. Stability system 10 is made up of a support wedge 11 connected to a bottom platform 12. Bottom platform 12 can be equipped with treads 13 for additional stability on slippery surfaces. Any kind of tread could be used.

Figure 1:
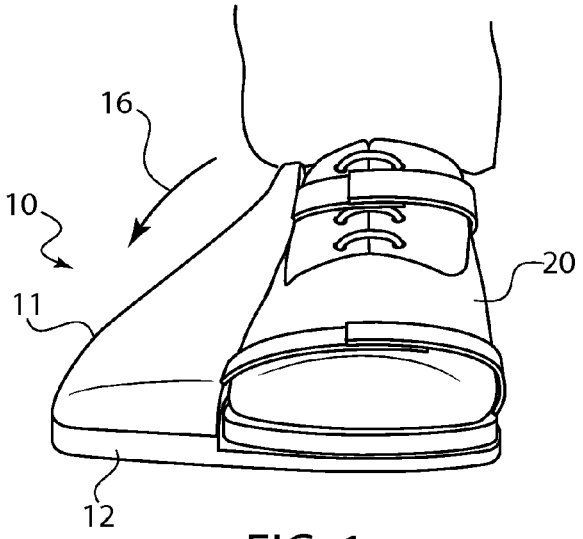
FIG. 1 shows a front view of a first embodiment of the stability system according to the invention.
Figure 2:
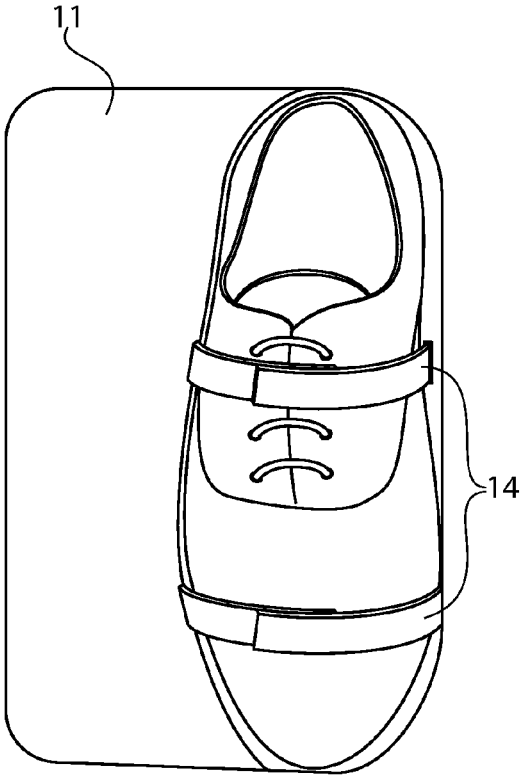
FIG. 2 shows a top view of the stability system.
Figure 3:
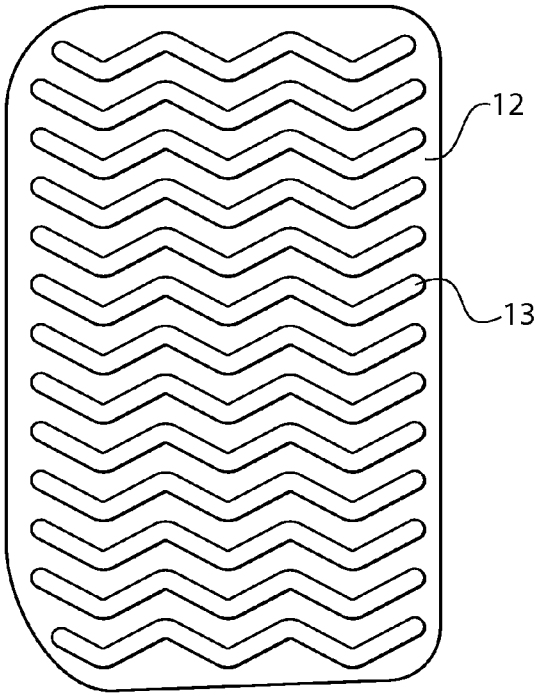
FIG. 3 is a bottom view of the stability system.

Stability system 10 is connected to a user's shoe 20 via straps 14, which can be held together via any suitable means, such as a hook-and-loop type closure (VELCRO), which is the type used in FIGS. 1 and 2. Buckles, snaps, ties, clips, D-rings or any other suitable connecting devices could also be used.

Figure 4:
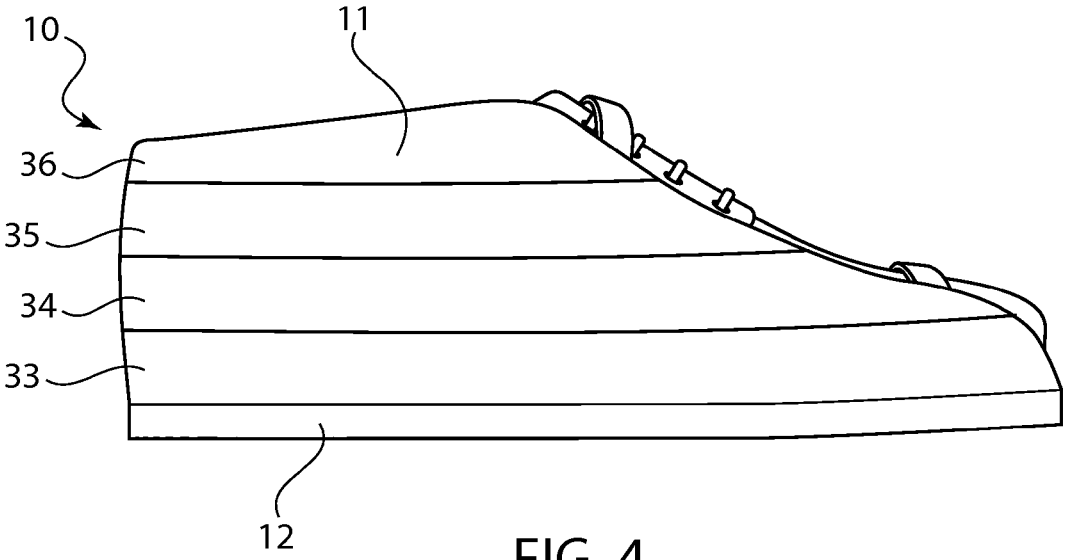
FIG. 4 is a side view of the stability system.
Figure 5:
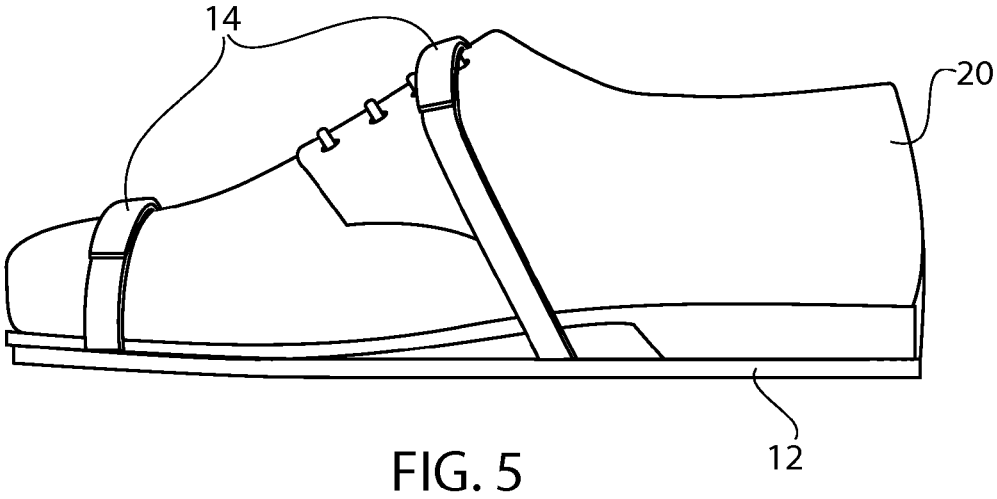
FIG. 5 is an opposite side view of the stability system.

Support wedge 11 is made up of a compressible material such as rubber or foam, which increases in resistance as pressure on the material is increased. For example, if a person starts to lean sideways and puts downward pressure along arrow 16 on support wedge 11, support wedge compresses easily at first but upon increasing pressure, exerts increasing resistance, so that support wedge 11 cannot compress beyond a certain amount and keeps its supporting properties. This compressibility leads to increased comfort for the user and allows support wedge 11 to absorb different movements without sacrificing fall prevention. Support wedge 11 has a triangular cross-section, but other shapes, such as trapezoidal, semicircular or rectangular could also be used. Support wedge 11 can be made using a 3-D printer or by any suitable means. Support wedge 11 can be of a unitary material or as shown in FIG. 4 made of layers of different materials 33, 34, 35, 36, each with different compression characteristics. Any number of layers could be used.

Stability system 10 can be configured to fit any size foot. It can be manufactured in different sizes or can be made to be trimmable for a custom fit. Support wedge 11 and bottom platform 12 can be manufactured as a single piece or in separate pieces. Generally, it is preferable to manufacture them in separate pieces so that bottom platform 12 can be made of a heavier, more durable material that does not need to be compressible.

Figure 7:
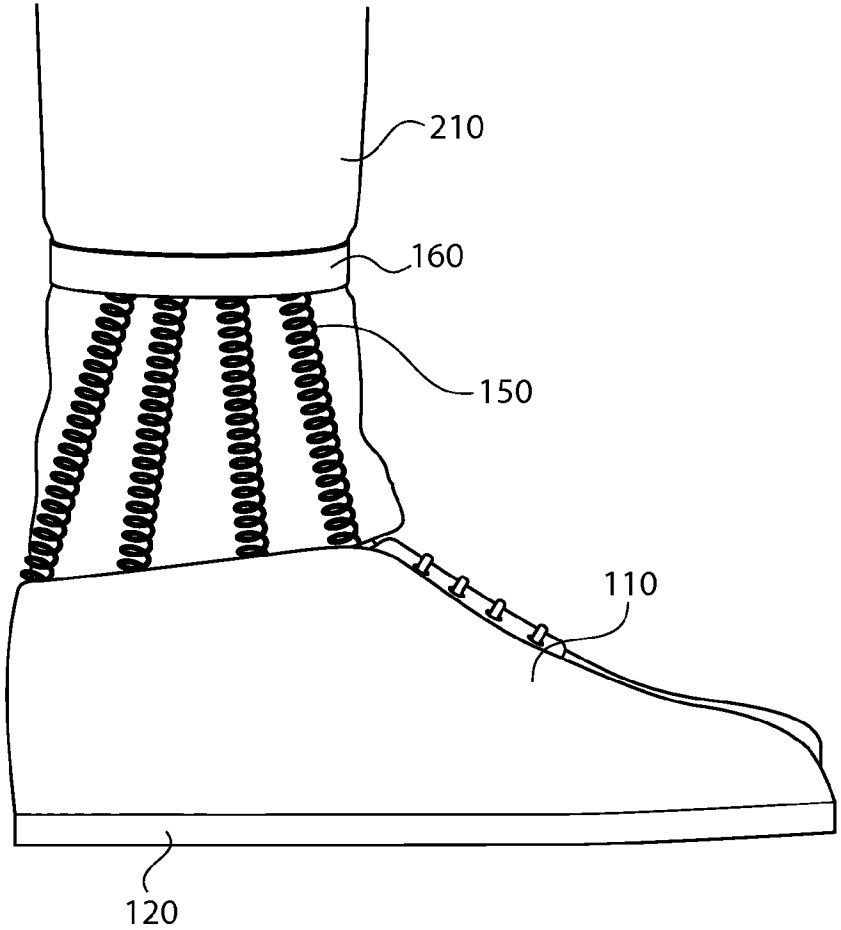
FIG. 7 is a side view of the stability system of FIG. 6.
Figure 6:
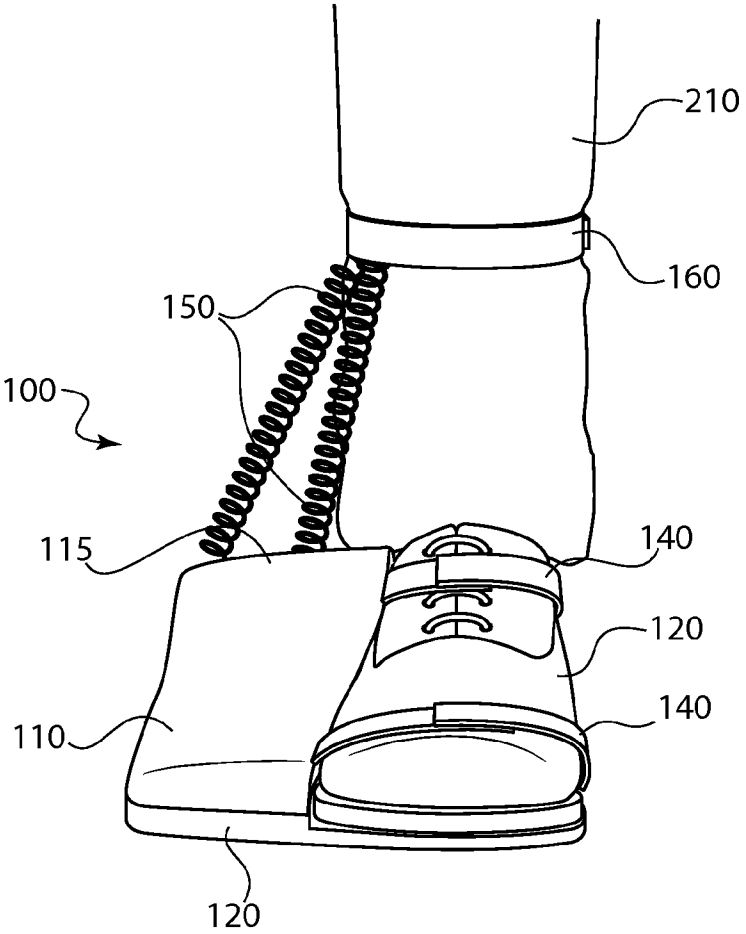
FIG. 6 is a front view of an alternative embodiment of the stability system according to the invention.

FIGS. 6 and 7 show an alternative embodiment of the invention, wherein stability system 100 comprises a support wedge 110 connected to a bottom platform 120 in the same manner as described above with respect to FIGS. 1-5. Here, support wedge 110 has more of a trapezoidal cross-section with a flat top. Compressible springs 150 are connected to the top surface 115 of support wedge 110 and extend upward, ending in a strap 160 that wraps around the user's leg 210. Strap 160 can be secured via any suitable means, such as hook-and-loop closures, buckles, hooks, snaps or ties. Support wedge 100 is connected to the user's shoe 200 in the manner described above with respect to FIGS. 1-5, i.e., via straps with a suitable securing device, such as hook-and-loop closures, snaps, hooks, buckles or ties.

The embodiment shown in FIGS. 6 and 7 lends even more stability though the use of springs 150 which attach high up on the user's leg via straps 160. At the first instance of sideways falling, springs 150 compress and absorb the lean, but exert increasing counter pressure as the downward pressure increases, to stop the user from falling. Springs 150 can be manufactured of steel or any other suitable material. It could also be envisioned that hydraulic or pneumatic springs could also be used.

With both embodiments, support wedge 11, 110 could be manufactured of any desired width, but a width of 1 to 3 inches is preferred. This gives suitable support without being cumbersome.

Accordingly, while only a few embodiments of the present invention have been shown and described, it is obvious that many changes and modifications may be made thereunto without departing from the spirit and scope of the invention.

What is claimed is:

1. A stability system comprising:

a support wedge having a bottom, an inner surface and an outer surface;

a bottom platform connected to the bottom of the support wedge and extending past the inner surface to create a space for receiving a bottom of the shoe;

attachment devices connected to the support wedge and bottom platform for connecting the stability system to a shoe, wherein the support wedge is formed from a compressible elastic material that compresses to a predetermined degree upon application of a downward force, such that the stability system exerts increasing resistance as the downward force increases.

2. The stability system according to claim 1, wherein the attachment devices are selected from the group consisting of straps, hooks, adhesives, hook-and-loop-type fasteners, D-rings and clips.

3. The stability system according to claim 1, wherein the support wedge is formed from rubber, foam or plastic.

4. The stability system according to claim 1, wherein the bottom platform is equipped with treads on a bottom surface thereof.

5. The stability system according to claim 1, wherein the bottom of the support wedge is between 1 and 3 inches wide.

6. The stability system according to claim 1, wherein the bottom platform and support wedge are formed in one piece.

7. The stability system according to claim 1, wherein the support wedge has a triangular cross-section.

8. The stability system according to claim 1, wherein the support wedge is made of a plurality of layers of different materials, wherein each of the different materials exhibits different compression characteristics.

9. A stability system comprising:

a support wedge having a bottom, an inner surface and an outer surface;

a bottom platform connected to the bottom of the support wedge and extending past the inner surface to create a space for receiving a bottom of the shoe;

a plurality of springs having a bottom end connected to a top of the support wedge and extending up to a top of the stability system, attachment devices connected to bottom platform or support wedge for connecting the stability system to a shoe; and an attachment strap at a top end of the stability system for attaching the stability system to a person's leg, wherein the springs compress a predetermined degree upon application of a downward force, such that the stability system exerts increasing resistance as the downward force increases.

10. The stability system according to claim 9, wherein the attachment devices are selected from the group consisting of straps, hooks, adhesives, hook-and-loop-type fasteners, D-rings and clips.

11. The stability system according to claim 9, wherein the support wedge is formed from rubber or plastic.

12. The stability system according to claim 9, wherein the bottom platform is equipped with treads on a bottom surface thereof.

13. The stability system according to claim 9, wherein the bottom of the support wedge is between 1 and 3 inches wide.

14. The stability system according to claim 9, wherein the bottom platform and support wedge are formed in one piece.

* * * * *